United States Patent [19]

Cherry et al.

[11] 3,930,536

[45] Jan. 6, 1976

[54] HEAT EXCHANGER

[75] Inventors: Harold Cherry; George E. Strudgeon, both of Erie, Pa.

[73] Assignee: Zurn Industries, Inc., Erie, Pa.

[22] Filed: May 16, 1974

[21] Appl. No.: 470,545

Related U.S. Application Data

[63] Continuation of Ser. No. 286,332, Sept. 5, 1972, abandoned.

[52] U.S. Cl. ..... 165/143; 29/157.3 R; 29/202 R; 285/138; 285/157

[51] Int. Cl. ..... F28f 9/26

[58] Field of Search ..... 165/143; 285/133, 138, 285/157; 29/157.3 R, 202 R

[56] References Cited

UNITED STATES PATENTS

| | | | |
|---|---|---|---|
| 912,671 | 2/1909 | Griesser | 165/143 |
| 2,274,233 | 2/1942 | Dewald | 165/143 X |

FOREIGN PATENTS OR APPLICATIONS

| | | | |
|---|---|---|---|
| 761 | 1888 | United Kingdom | 165/143 |
| 25,232 | 1908 | United Kingdom | 165/143 |

*Primary Examiner*—Albert W. Davis, Jr.

[57] ABSTRACT

A sludge heat treat system wherein a tube in the tube heat exchanger consists of multiple set of small tubes spaced inside of larger tubes. At the end of each run there is a return bend that conveys the fluid on the inner tube around to the next tube in the tube exchanger and also conveys the outer tube fluid to the next tube system. The inner tube system is carrying sludges that are obtained in a sewage treatment plant or an industrial waste treatment plant or any other type of treatment plant where sludges are produced and it is desired to heat treat these in order to release the bound waters and thereby effect a dewatering of the sludge cake which is not possible without sludge heat treat systems. The outer tube conveys a liquid which is usually water which has been treated. The outer tube conveys a liquid which is usually treated water which gives up the heat from an outside source to the sludge on the inner tube in a consistent manner. The inner tube takes the heat from the sludge and transfers it to the water to preheat the water. The return bend is designed so that the sludge on the inner tube is conveyed through the outside portion of the return bend and the water from the outer tube is channeled through a channel on the inner side of the return bend. Built into the return bend is a heating surface where there can continue to be a transfer of heat between the water and sludge within the return bend.

1 Claim, 5 Drawing Figures

HEAT EXCHANGER

This is a continuation, division, of application Serial No. 286,332 now abandoned, filed Sept. 5, 1972.

REFERENCE TO PRIOR ART

A heat exchanger having concentric tubes and return flow heating exchange units is shown in U.S. Pat. Nos. 3,171,478 and 3,593,782. However, these patents do not show the improved return bend member with the clean out plugs as claimed in the present application.

OBJECTS OF THE INVENTION

It is an object of the invention to provide an improved heat exchange device.

Another object of the invention is to provide an improved return bend in combination with the heat exchange device.

Yet another object of the invention is to provide a heat exchange device that is simple in construction, economical to manufacture, and simple and efficient to use.

Another object of the invention is to provide a heat exchange device having concentric sinuous tubes with an improved return bend at the ends of the tubes.

Another object is to provide a structure wherein sludge can be removed from the inside of tubes without disconnecting the water flow path.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
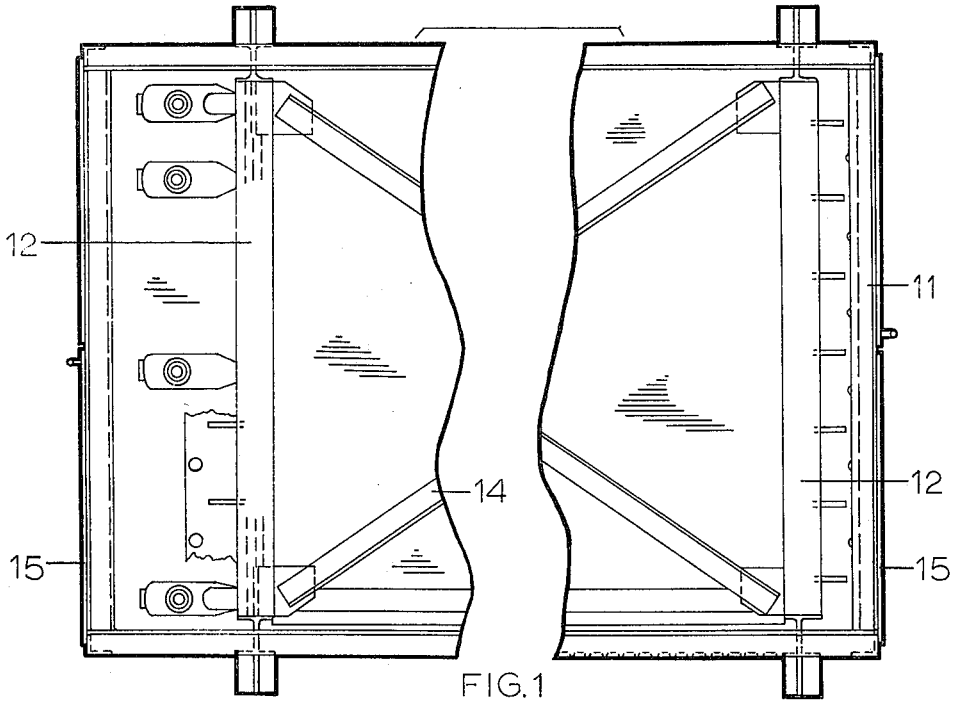
FIG. 1 is a top view of the heat exchanger according to the invention.
Figure 2:
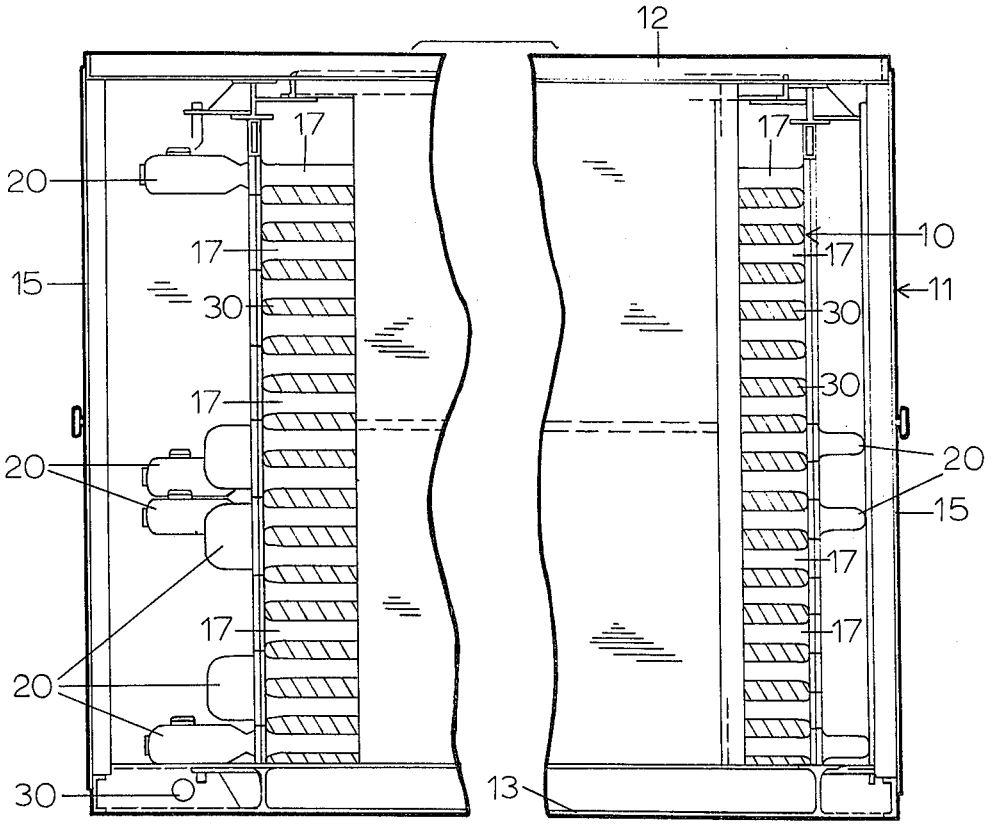
FIG. 2 is a side view of the heat exchanger.
Figure 3:
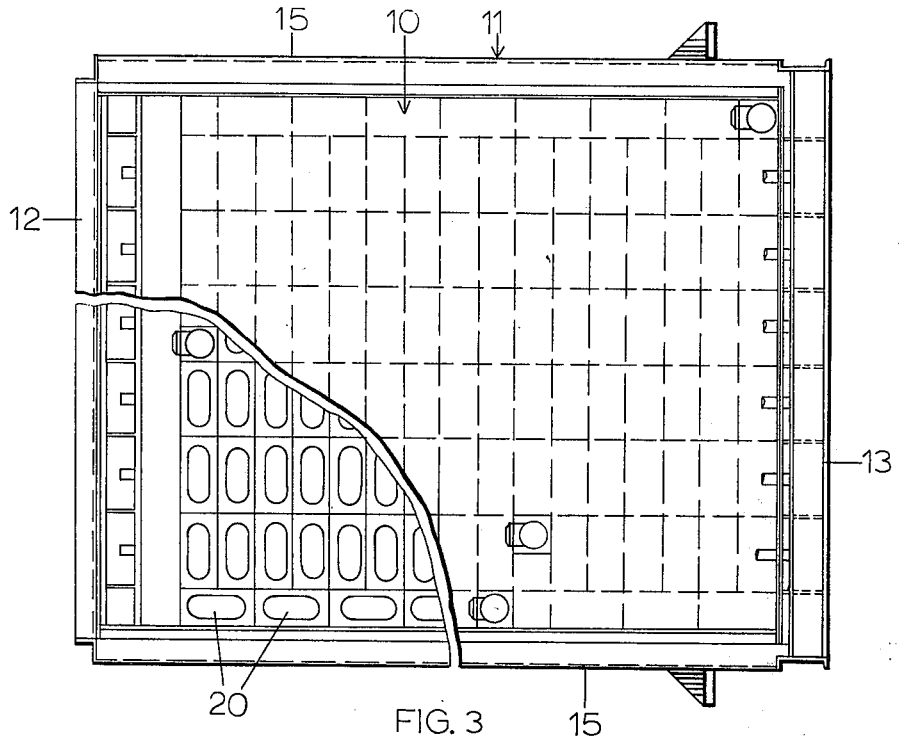
FIG. 3 is an end view of the heat exchanger.

Now with more particular reference to the drawings, the heat exchanger shown generally at 10 has a frame 11 which could be made of structural steel, having top frame members 12, bottom frame members 13, braces 14, and side members 15. The heat exchange elements indicated are made up of inner tubes 16 and outer tubes 17 supported concentrically around the inner tubes. The heat exchange elements are laid in parallel rows in a stack supported in the frame with suitable insulation 30 around the outside thereof.

Figure 4:
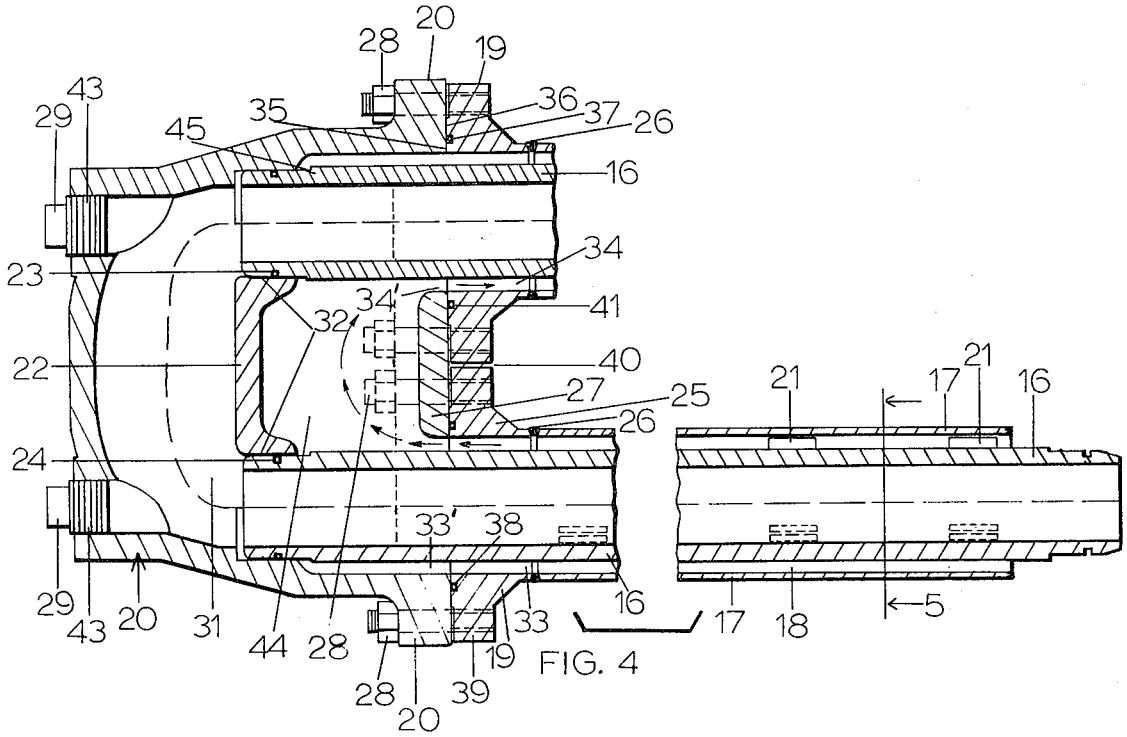
FIG. 4 is an enlarged cross sectional view of the return bend.
Figure 5:
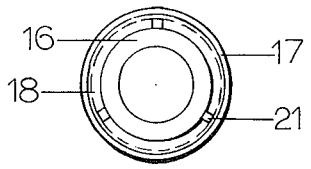
FIG. 5 is a cross sectional view taken at line 5—5 of FIG. 4.

The details of the return bends 20 are best shown in FIGS. 4 and 5. Adaptor flange 25 has two holes 33 and 34 around which the outer tubes 17 are welded at 26. Holes 33 and 34 in adaptor flange 25 are aligned with holes 33' and 34' in return bend 20. The area around the holes on adaptor flange 25 has a surface 35 which engages a flat surface 36 on the return bend 20 and O-rings 37 and 38 are disposed in a suitable groove 41 and form seals therebetween. The adaptor flange 25 is held to the return bend 20 by means of bolts 28 which threadably engage the flange at 39 and hold the return bend 20 and the adaptor flange 25 together. The return bend 20 has an internal partition 22 with two spaced bores 32 that are aligned with holes 33' and 34'. The ends of the inner tubes 16 are received in bores 32 in partition 22 of the return bend 20. The O-rings 23 and 24 form a seal between the outside of the tubes 16 and the inside of holes 32 and also provide a sliding fit for thermal expansion.

Pipe plugs 29 are inserted in openings 43 in the return bend through which a cleaning instrument can be inserted. The inner tubes 16 are hold in spaced relation to the outer tubes 17 be the spacer members 21.

This invention relates to heat exchangers and more particularly to heat exchangers for use in the heat treatment of sewage sludge and other liquids. In the sludge heat treatment system disclosed herein, sludge is fed through a tube in tube heat exchanger in which the influent sludge is heated from a low temperature to a heat treatment temperature by the transfer of heat from high temperature hot water to sludge. Similarly, after the heated sludge is detained at the heat treatment temperature for the specified time, the sludge is fed through a tube in tube heat exchanger in which the sludge is cooled by transferring its heat to water, this water being an integral part of the total closed water circuit providing both the heating and cooling medium and obtain a high percentage of heat recovery.

The tube in the tube heat exchanger (heater or cooler), consists of a sinuous configuration of small tubes or pipe centrally located within a larger tube or pipe. The inner tube system is the conduit through which the sludges flow while the annular space between the inner and outer tubes or pipes is the conduit through which water flows.

In the case of the heater, heat is transferred from the hot water media through the wall of the inner tube or pipe to the sludge flowing through the inner tube or pipe. In the case of the cooler, heat is transferred from the hot sludge flowing through the inner tube 16 through the wall of the inner tube to the heat absorbing media (water) flowing in the annular space 18.

At the end of each run which conveys both fluids, that is, the fluid on the inside of the inner tube 16 as well as the fluid in the annular space 18, to the next successive tube in the heat exchanger, is a return bend 20.

The design of the return bend 20 is such that although both fluids are conveyed through it, either parallel or counter current flow, the two streams are separated from each other by mechanical joints which prevent direct contact and therefore intermixing with each other. This design does provide additional heat transfer surface within the return bend 20 to permit an exchange of heat from one fluid to the other.

Because the metal temperatures of the inner tube 16 and outer tube 17 are of different magnitudes, provision must be made for relative thermal expansion between the two without causing any deleterious stresses in either of these tubes. This provision is incorporated in the design of the return bend by utilizing O-ring seals 23 and 24 between the inner tubes 16 and the body of the return bend 20. The O-ring seals 23 and 24 isolate the sludge from the water side while at the same time permitting thermal growth or contraction of the inner pipe without imposing any deleterious stresses to the outer tube 17.

The return bend 20 may be removed from the flanged member 19 by removing the bolts 28. Thus the return bend can be lifted off the ends of the inner tubes and the ends of the inner tubes will project from the ends of the flanged member 19.

It will be noted that the partition 22 divides the return bend member 20 into two separate chambers indicated at 31 and 44.

When the phenomenon of scale-like material occurs, as previously discussed, further deposition of the solids in the sludge on the cake also occurs, leading to a blockage of flow within the conduit. The usual method of existing heat exchangers is to try to scour this buildup out by increasing flow through the unit, utilizing higher velocities and/or cleaning agents and, if this us unsuccessful, the removal of the return bends to expose the inner or sludge carrying conduit. This exposure would then permit mechanical cleaning of the sludge carrying conduit. At the same time the exposure of the ends of the tubes under existing designs opens both sides of the heat exchanger to the atmosphere thus producing a loss of the fluid and pressure on the annular side.

The design of the return bend covered by this application incorporates access openings closed by plugs 29 which permit the insertion of mechanical or fluid cleaning devices to the inner sludge carrying tube 16. This feature, coupled with the O-ring seals 23 and 24, described previously, permits the mechanical cleaning of the inner sludge carrying conduit without disturbing (causing a loss of or drop in pressure of) the fluid in the annular space 18. The provision of these access openings permits inspection as well as cleaning of the inner sludge carrying tube.

A further advantage of this return bend design is the ease of determining the erosion effect of sludge flow within the return bend while the heat exchanger is operating. This can be done by means of an ultrasonic measuring device. Erosion of the metal on the sludge side is common where there is a change in direction as is the case in a return bend. Sludge contains eroding materials and it is therefore possible, with this return bend design, to predict when return bends are approaching a failure condition without interfering with the system operation such as shutting down, draining fluid from both sides of the exchanger, physically removing the return bend and then mechanically measuring the extent of erosion. In this return bend design, sludge flows through the outside channel where access with an ultrasonic tester is simple.

Further, the return bends are equipped with connections which permit the application of pressure and temperature sensing devices to both the sludge and water sides to permit measurement of pressure loss or of the temperature gradient through individual tubes, through combinations of tubes or through the entire exchanger.

With the design of the present return bend and system with the fact that the sludge is conveyed to the outside of the return bend, the operator is able to put and build bosses which are openings tapped and plugged in direct line with each of the inner tubes. At any time that it is desired that the inner tube be either inspected or rodded or cleaned, the sludge can be taken out of the inner tube by draining it, opening up the corresponding return bend plugs on each end and putting a cleaning device in it and spinning it down through or running it down through the inner tube, thus cleaning it. After this is cleaned or inspected, the plugs can be put back in and it can be filled back up with sludge and be back in operation. This is a simple task.

Further advantages of the present return bend are that, by using a sonic tester, the operator can determine the erosion or the wearing away of the metal in the return bend and thereby calculate the effect of grits and other eroding materials in the sludge and predict when return bends or erosion is going to get into a failure position through being able to put this tester on the outside of the return bend and measure the thickness without disturbing the system's operation.

Further, by putting either pressure sensing devices or temperature sensing devices in the plug in the return bend, it is possible to measure either the pressure loss through this system or through any individual pipes and also the temperature gradient between points of measurement.

The same temperature and pressure measurement on the water side can be done through a top hole that is located on the water side of the return bend.

The present system utilizes one heat exchanger to transfer the heat from the water to the sludge thereby ending up with the desired sludge temperature, and after a discreet holding time, it can be put through another heat exchanger which is, in effect, a cooler in which the water, which is colder than the sludge, takes the heat out of the sludge conserving the heat and thereby cooling it down to the desired temperature for further thickening or treatment. The advantages of the return bend and the present system design is also applicable to both the heater and the cooler.

The foregoing specification sets forth the invention in its preferred practical forms but the structure shown is capable of modification within a range of equivalents without departing from the invention which is to be understood is broadly novel as is commensurate with the appended claims.

I claim:

1. A heat exchanger for heating sludge comprising a plurality of stacked parallel heat exchange elements, each said heat exchange element comprising an outer tube and an inner tube, return bends connecting each said inner tube in fluid flow relation with the inner tube of an adjacent said element and connecting each said outer tube in fluid flow relation with a said outer tube of said adjacent element, each said outer tube providing a flow path for hot liquid to an outer tube of a said adjacent element, each said return bend comprising a hollow body having a first flat external and surface and a second generally flat external and surface disposed generally parallel to each other, an internal partition in said hollow body generally parallel to said flat and surfaces and dividing said hollow body into a first chamber and a second chamber, two first holes formed in said first end surface of said body and two spaced second holes in said second end surface of said body, two spaced bores in said partition, each said spaced bore being disposed in alignment with a said hole in said first end and a said hole in said second end surface, each said inner tube having a peripherial surface adjacent an end slidably received in a said bore in said partition and having sealing means between said ends of said inner tubes and the inside of said bore, a flanged member having a flat surface resting on said first end surface of said body and sealing means between said flat surface of said body and said flat surface of said flanged member, two spaced openings in said flanged member align with said first holes in said first end surface of said return bend, each said outer tube being fixed to said flanged member and forming a continuation of a flow path through said flanged member, through said second openings in said first end of said body and through said second chamber to another said outer tube and first bolt means clamping said flanged member to said return bend, each of said bodies being adapted to be removed from said flanged member and from said outer tubes and said inner tubes by removing said bolt means from said flanged member and sliding said inner tubes out of said spaced bores in said partition and from said holes in said first end of said body, and threaded plug means in said openings in said second ends of said body whereby access to said inner tubes may be obtained by removing said plugs, said second openings being substantially smaller than said inner tubes, said second end of said body having an inner end surface curved about a relatively large radius and providing a contoured path for sludge flowing through said inner tubes from said inner tube to another said inner tube and defining an end of said first chamber providing a relatively low head loss and sludge flowing from one said inner tube to another, said first chamber having a relatively large cross sectional area as compared to the cross sectional area of said inner tubes whereby plugging of said chamber by said sludge is inhibited.

* * * * *